United States Patent [19]

Hosogai et al.

[11] Patent Number: 4,567,455

[45] Date of Patent: Jan. 28, 1986

[54] CIRCUIT INTERRUPTER

[75] Inventors: Setsuo Hosogai; Hiroshi Fujii; Shigemi Tamaru; Junichi Terachi; Takuo Takatsuka, all of Fukuyama; Hideo Suhara, Fukayasu, all of Japan

[73] Assignee: Mitsubishi Denki K.K., Tokyo, Japan

[21] Appl. No.: 608,982

[22] Filed: May 10, 1984

[30] Foreign Application Priority Data

| | | | |
|---|---|---|---|
| May 16, 1983 | [JP] | Japan | 58-74205[U] |
| May 16, 1983 | [JP] | Japan | 58-74206[U] |
| May 16, 1983 | [JP] | Japan | 58-74207[U] |
| May 16, 1983 | [JP] | Japan | 58-74208[U] |
| May 16, 1983 | [JP] | Japan | 58-74209[U] |
| May 16, 1983 | [JP] | Japan | 58-74210[U] |
| May 16, 1983 | [JP] | Japan | 58-74211[U] |

[51] Int. Cl.[4] ..... H01H 75/12

[52] U.S. Cl. ..... 335/16; 335/35; 335/195

[58] Field of Search ..... 335/16, 23, 4, 10, 35, 335/189, 8, 191, 195

[56] References Cited

U.S. PATENT DOCUMENTS 4,480,242 10/1984 Castongway et al. ..... 335/194

4,482,877 11/1984 Castongway et al. ..... 335/192

*Primary Examiner*—George Harris

*Attorney, Agent, or Firm*—Robert E. Burns; Emmanuel J. Lobato; Bruce L. Adams

[57] ABSTRACT

A circuit interrupter which comprises a pair of separable contact structures each including a contact element, at least one of the contact structures being movable between a closed position and an open position relative to the other contact structure for opening and closing an electric circuit extending through the circuit interrupter, the movable contact structure having an arm support that is pivotable about an axis, a movable contact arm pivotally supported on the arm support and extending in a parallel and an opposite direction to the other contact structure for generating an electromagnetic repulsive force therebetween, and a biasing means connected between the arm support and the movable contact arm for biasing the movable contact arm to a predetermined position with respect to said arm support, and an operating mechanism connected to the arm support of the movable contact structure for separating the movable contact structure from the stationary contact structure in response to an overcurrent flowing through the circuit interrupter, the movable contact arm having a common pivot axis to the pivot axis of the arm support.

11 Claims, 14 Drawing Figures

CIRCUIT INTERRUPTER

BACKGROUND OF THE INVENTION

This invention relates to circuit interrupters.

A typical circuit interrupter comprises a pair of separable contact structures, at least one of which is movable, for interrupting an electric current flowing therethrough, and an operating mechanism operatively connected to at least one of the separable contact structures for opening and closing the contacts in response to overcurrent conditions in the circuit. The movable contact structure generally includes a pivotal arm support operated by the operating mechanism, a movable contact arm pivotally supported on the arm support and a biasing spring disposed between the arm support and the movable contact arm for biasing the movable contact arm toward a predetermined position relative to the arm support. The movable contact arm extends in a structurally parallel and an electrically opposite direction (with respect to current flow) to the stationary contact structure in order that an electromagnetic repulsive force, that separates the separable contacts against the biasing action of the spring, may be generated between the movable and the stationary contact structures during an overcurrent condition.

One example of the circuit interrupter of the above-described type is disclosed in U.S. Pat. No. 3,525,959 issued to Ellsworth et al. In this circuit interrupter, a movable contact structure comprises a switch arm secured to and projecting perpendicularly from a cross bar which rotatably extends through three pole units of the circuit interrupter, and a movable contact arm carrying a movable contact element at its tip portion and which is pivoted on a projecting end of the switch arm at its end portion so as to constitute, together with the switch arm, an elongated movable contact structure pivotal about a pivot axis located substantially at a midway portion of the entire movable contact structure. When the movable contact structure is to be actuated by an operating mechanism due to an overcurrent flowing through the circuit interrupter, the switch arm is rotated to separate the contacts about its pivot axis which is also the pivot axis of the cross bar. However, when an abnormally high overcurrent flows, this high current must be immediately interrupted and a mechanism for this immediate interruption is known wherein an electromagnetic repulsive force generated by an electric current flowing in opposite directions in a pair of parallel conductors, is utilized. With the conventional design utilizing the electromagnetic repulsive force, however, the distance from the movable contact element to the pivot axis of the movable contact arm is much shorter than that from the movable contact element to the pivot axis of the overall movable contact structure, which is also the pivot axis of the cross bar. Therefore, the movable contact arm must be rotated by a larger angle for obtaining the same separation distance, and the spring between the movable contact arm and the switch arm requires a larger deflection, resulting in a slow response speed and larger spring fatigue.

The circuit interrupter disclosed in the above cited patent utilizes in the movable contact structure a torsion spring disposed between the movable contact arm and the switch arm for providing the required contacting pressure between the movable and the stationary contact elements. This spring, which is relatively strong, must be assembled into the movable contact structure with substantial difficulty because of its strong spring force.

Also, with the conventional circit interrupter disclosed in the above cited patent, when the movable contact structure is moved to a separated, open position, movement of the structure is limited by a metallic stop mounted on the inner wall of the housing at the position above the movable contact arm which the contact arm abuts at its top surface or back surface opposite to the contact element. However, repeated strong impacts due to the abutment of the movable contact arm against the stop often causes deformations or distortions in the movable contact arm, resulting in a poor electrical contact between the movable and the stationary contact elements when they are closed.

Also, since the movable contact arm carrying the contact element thereon is pivotally connected at the tip of the switch arm, it has been very difficult to keep the alignment between the longitudinal axes of the movable contact arm and the switch arm, resulting in the movable contact element not being in registry with the stationary contact element even in the closed position.

SUMMARY OF THE INVENTION

Accordingly, an object of the present invention is to provide a circuit interrupter in which the response speed is high and the spring fatigue is small.

Another object of the present invention is to provide a circuit interrupter in which the assembly of a relatively strong biasing spring in the movable contact structure is relatively easy.

Still another object of the present invention is to provide a circuit interrupter in which the separation distance of the separable contact element is increased.

A further object of the present invention is to provide a circuit interrupter in which the distortion of the movable contact arm due to the abutment against the stop member is prevented.

Still another object of the present invention is to provide a circuit interrupter in which the movable contact element carried on the movable contact arm is prevented from being out of registry with the stationary contact element.

With the above objects in view, a circuit interrupter of the present invention comprises a pair of separable contact structures each including a contact element, at least one of the contact structures being movable between a closed position and an open position relative to the other contact structure for opening and closing an electric circuit extending through the circuit interrupter, the movable contact structure having an arm support that is pivotal about an axis, a movable contact arm pivotally supported on the arm support and extending in parallel and opposite directions to the the other contact structure for generating an electromagnetic repulsive force therebetween, a biasing means connected between the arm support and the movable contact arm for biasing the movable contact arm to a predetermined position with respect to said arm support, and an operating mechanism connected to the arm support of the movable contact structure for separating the movable contact structure from the stationary contact structure in response to an overcurrent flowing through the circuit interrupter, the movable contact arm having a common pivot axis to the pivot axis of the arm support. In a preferred embodiment of the present invention, the biasing means comprises a substantially U-shaped double torsion spring, two leg portions of the "U" independently engaging the arm support and a bight portion of the "U" engaging the movable contact arm, thereby enabling the two leg portions of the "U" to be brought into engagement with the arm support independently of each other. The arm support may have a spring engaging pin extending therethrough, and the leg portions separately engaging the pin. Also, the spring engaging pin may have formed at its opposite ends circumferential grooves for receiving therein the leg portions of the U-shaped torsion spring, thereby accurately positioning the pin.

In another embodiment of the present invention, a circuit interrupter may comprise a housing having formed therein a stopper surface, and the movable contact structure has a stopper projecting from an end portion thereof opposite to the movable contact element and engageable with the stopper surface on the housing for limiting the range of the movement of the movable contact arm. A circuit interrupter according to another embodiment of the present invention further comprises means, disposed between the arm support and the movable contact arm, for limiting a range of lateral swinging movement of the movable contact arm about an axis perpendicular to the pivot axis of the movable contact arm. The operating mechanism of the circuit interrupter may include a toggle mechanism including a pair of toggle links spaced apart from each other by a distance sufficient to accommodate therebetween the movable contact arm.

BRIEF DESCRIPTION OF THE DRAWINGS

The present invention will become more readily apparent from the following description of the preferred embodiment thereof taken in conjunction with the accompanying drawings, in which.

DESCRIPTION OF THE PREFERRED EMBODIMENTS

Figure 1:
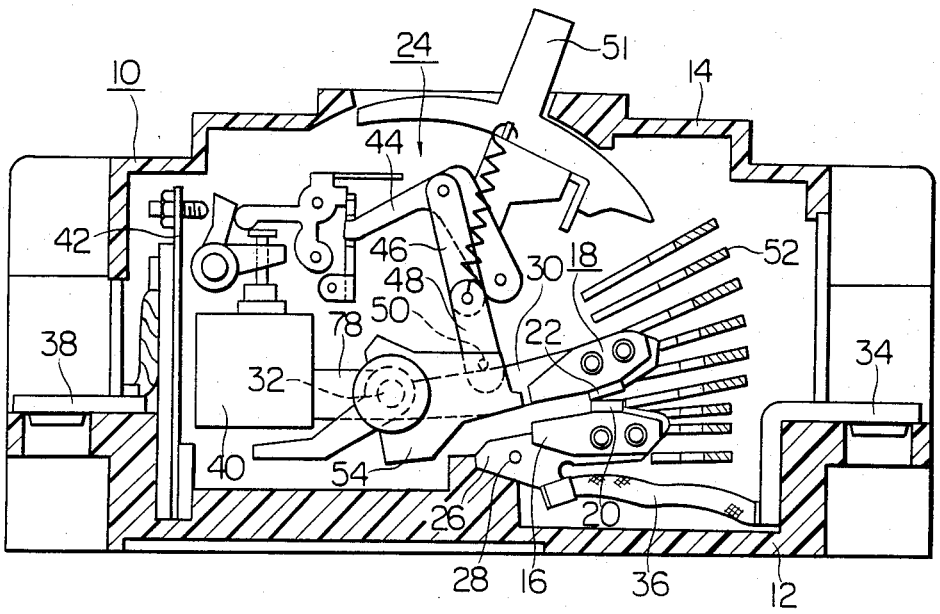
FIG. 1 is a schematic sectional view of a circuit interrupter of the present invention.

FIG. 1 illustrates a three pole circuit interrupter constructed in accordance with the present invention. The circuit interrupter comprises a housing 10 comprised of a main body 12 and a cover 14 both made of an electrically insulating material. The main body 12 and the cover 14 include side walls, end walls, a top wall and two partition walls, a bottom wall and two partition walls parallel to the side walls. The main body 12 and the cover 14 define, when assembled, three substantially closed compartments partitioned by the partition walls from each other for the respective poles of the circuit interrupter.

Within each of the pole compartments, is a pair of separable contact structures 16 and 18. The contact structure 16 includes a contact element 20 mounted on arigid conductor 26 pivotally mounted by a pivot pin 28 on the inner surface of the bottom wall of the housing 10, and the movable contact structure 18 includes a movable contact element 22 carried on an elongated movable contact arm 30 pivotally supported on an electrically insulating cross bar 32 as will be described in more detail later. The cross bar 32 extends through the partition walls into each of the three pole compartments so that the contact structure pairs 16 and 18 in the pole units simultaneously open or close. The contact structure 16 is connected to a source side terminal 34 through a flexible conductor 36. The movable contact structure 18 is connected to a load side terminal 38 through the movable contact arm 30, a flexible conductor (not shown), an electromagnetic coil 40 of the electromagnetic trip device and a bimetal element 42 of the thermally responsive trip device. As is well known in the art, an operating mechanism 24 of the central pole unit includes, in addition to an automatic operating mechanism composed of the electromagnetic and the thermally responsive trip devices 40 and 42 provided in the respective pole units, a releasable latch member 44 released upon the actuation of the trip devices 40 or 42, a pair of toggle links 46 and 48 connected to the movable contact structure 18 through pins 50 for rotating the movable contact arm 30 in response to the movement of the latch member 44, and an operating handle 51. Each of the three pole units includes an arc extinguisher 52 having a plurality of arc extinguishing plates well known in the art.

According to the present invention, the movable contact structure 18 comprises an arm support 54, a movable contact arm 30 and a biasing spring 56. As particularly shown in FIG. 3, the arm support 54 is an integrally molded member made of an electrically insulating material. The arm support 54 comprises a hollow box-shaped base portion having a large square opening 58 defined by a top wall, a bottom wall and two side walls, a pivot pin 60 on the outside surface of each of the side walls of the base portion and pairs of parallel side arms 62 integrally extending from the side walls of the base portion. Each side arm 62 has formed on its inner face of the tip portion an inward projection 64 which functions as a stopper as will be described in more detail later. Three box-shaped base portions of the arm support 54 are arranged in side-by-side relationship with the central axes or the pivot axes of the pivot 60 aligned so that all of the side arms 62 are in parallel and moved simultaneously. Between the box-shaped base portions of the arm support 54, are cams or stoppers 66 eccentrically formed on the pivot 60 of the arm support 54. The box-shaped base portions of the arm support 54 have formed at their edges, at which pivot studs 60 are disposed, U-shaped grooves 68 for receiving therein a pin 70 shown in FIG. 2 which supports the arm support 54 and hence the movable contact structure 18 as will be described in more detail later.

Figure 2:
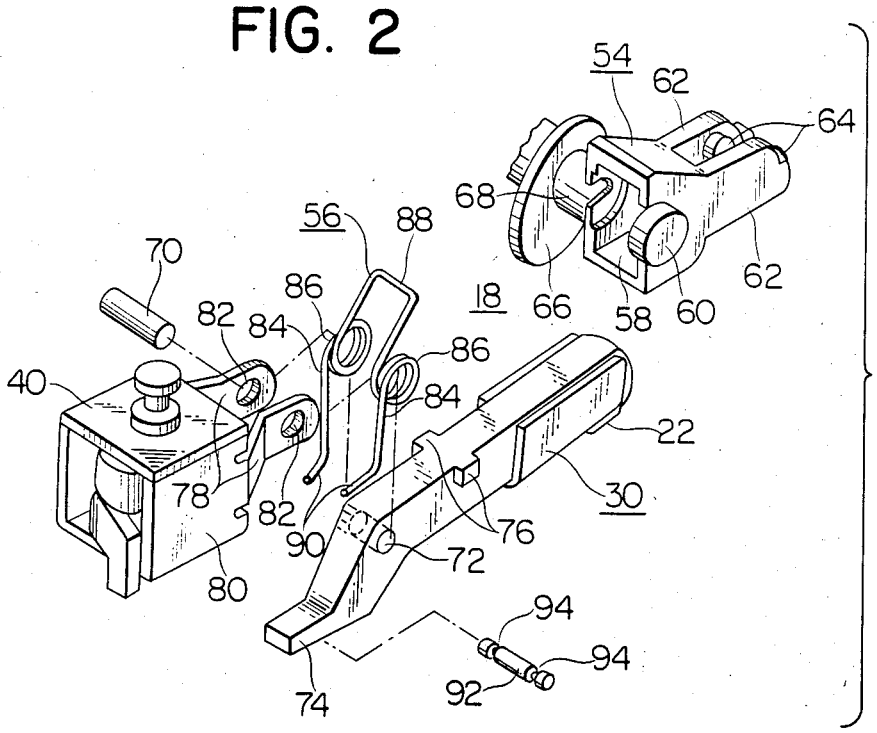
FIG. 2 is an exploded perspective view illustrating the assembly of the movable contact structure with the arm support.

As is best shown in FIG. 2, the movable contact arm 30 is an elongated rigid electrically conductive member having at one end thereof the movable contact element 22 and at the other end thereof an aperture 72 for receiving therein the pivot pin 70. The contact arm 30 also has a reduced-thickness tail 74, and projections 76 which are disposed on the side faces at an intermediate position of the contact arm 30. The movable contact arm 30 may be pivotally supported in the interrupter by a pivotal connection to any stationary structure member within the housing 14, but in the illustrated embodiment, the movable contact arm 30 is connected by the pivot pin 70 to a pair of brackets 78 having holes 82 for receiving the pin 70 therein and projecting from a frame 80 of the coil of the electromagnetic trip device 40 which is rigidly secured within the housing 14.

The torsion spring 56 is a substantially U-shaped spring member comprising a pair of leg portions 84 each preferably having a coil 86, and a bight portion 88 connecting the two leg portions 84. It is to be noted that the free ends 90 of the leg portions 84 of the spring 56 are slightly bent so that a reliable engagement between the bent ends 90 and a spring stopper pin 92 is ensured. The pin 92 is longer than the width of the tail 74 of the movable contact arm so that opposite ends of the pin 92 project from the side faces of the contact arm 30. In the illustrated embodiment, the pin 92 has two circumferential grooves 94 for receiving therein the bent free ends 90 of two leg portions 84 of the spring 56.

Figure 4:
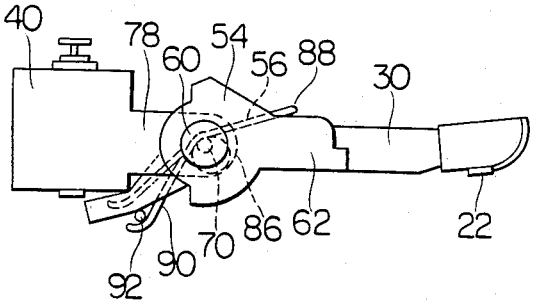
FIG. 4 is a side view of the movable contact structure.
Figure 5:
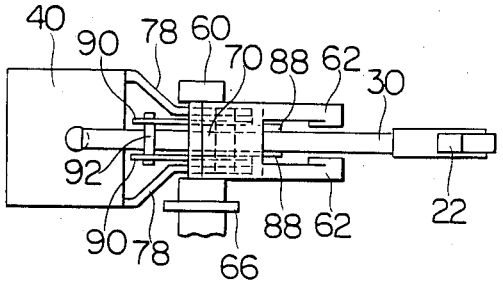
FIG. 5 is a plan view of the movable contact structure shown in FIG. 4.

FIGS. 4 and 5 illustrate the assembled movable contact structure 18 pivotally connected to the electromagnetic trip device 40. In assembling, the coil portions 86 of the spring 56 are aligned with the aperture 72 in the movable contact arm 30, and this assembly is inserted between the mounting brackets 78 of the electromagnetic trip device 40 with the coil portions 86 and the aperture 72 aligned with the holes 82 in the brackets 78. The bight portion 88 of the spring 56 is placed over the top face of the movable contact arm 30. Then the pin 70 can be easily inserted through the aligned holes and apertures of the assembly.

Figure 3:
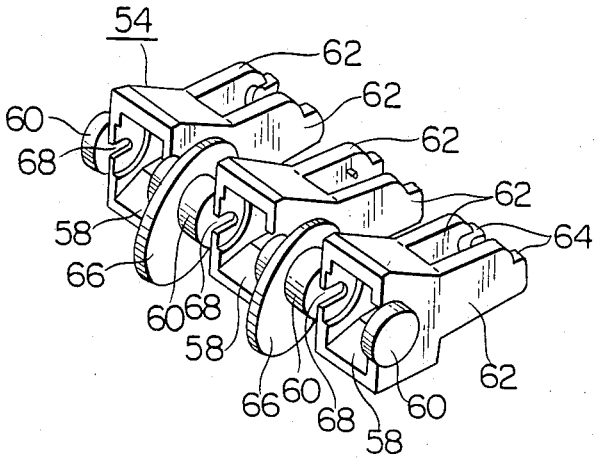
FIG. 3 is a perspective view of an arm support of the movable contact structure.
Figure 6:
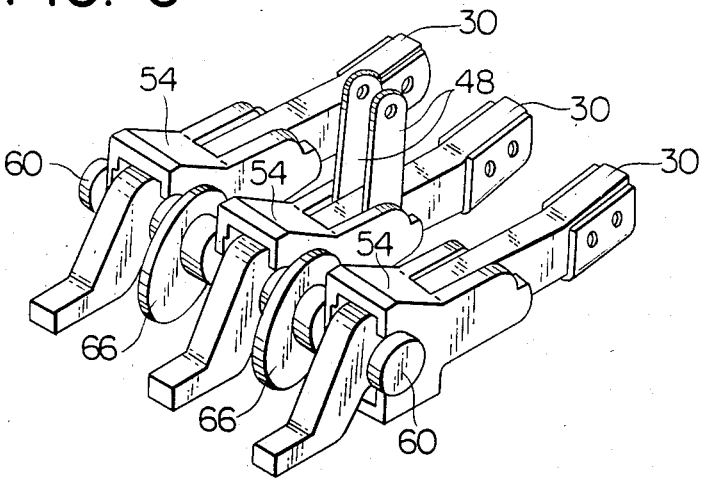
FIG. 6 is a perspective view of a movable contact structure.

This assembly, in which the movable contact arm 30 as well as the spring 56 is pivotally connected by the pin 70 to the electromagnetic trip device 40, is inserted into the aperture 58 of the arm support 54 shown in FIG. 3 until the U-shaped slots 68 receive the end portions of pin 70 and the central axis of the pin 70 and the pivot axis of the arm support 54 come into registry as shown in FIG. 6.

In order to spring bias and keep in position the arm support 54, the stopper pin 92 is placed on the lower surface of the tail portion 74 of the movable contact arm 30 and the bent free ends 90 of the spring 56 are brought into pressure engagement with the grooves 94 formed in the pin 92, with the bight portion 88 of the spring 56 pressure contacting the top wall of the base portion of the arm support 54. In this connection it is to be noted that, since the free ends 90 of the spring 56 can be separately engaged with the pin 92, the force necessary in deflecting the respective free ends 90 of the spring 56 by an amount required for allowing the insertion of the pin 92 may be only one half of the total spring force provided by the spring 56. Therefore, the assembly of the spring biased movable contact structure 18 is relatively easy even when a relatively strong spring is employed.

Figure 7:
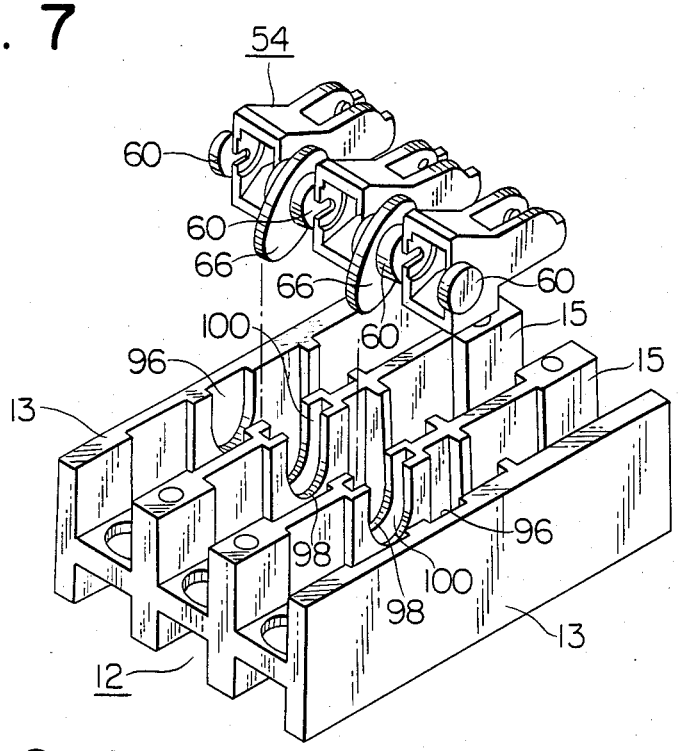
FIG. 7 is a perspective view of a base portion of a housing in which the arm support is assembled.

Then, the assembly is placed in position within the housing 14 by inserting the pivots 60 of the arm support 30 into U-shaped slots 96 and 98 formed in the side walls 13 and the partition walls 15 of the housing main body 12 as illustrated in FIG. 7 which shows the arm support 54 as well as the base or the main body 12 of the housing 14 in an exploded perspective view. The U-shaped slots 96 formed in the side walls 13 are dead end slots in that they extend only half-way through the thickness of the housing side walls 13 from the inner surface. The U-shaped slots 98 formed in the partition walls 15 of the main body 12 extend completely through the thickness of the partition walls 15. It is to be noted that each of the partition walls 15 has formed in the respective U-shaped slot 98 a groove 100 for receiving therein the cam-shaped stopper 66 formed on the arm support 54 as best shown in FIGS. 8 to 10.

Figure 8:
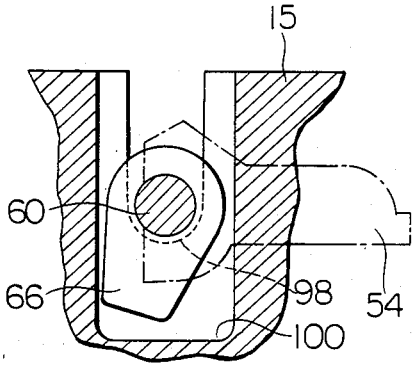
FIGS. 8 to 10 are schematic views illustrating various positions of a stopper relative to a stopper surface formed in the housing inner surface.
Figure 9:
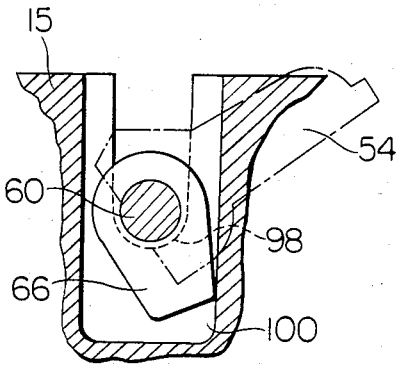
Figure 10:
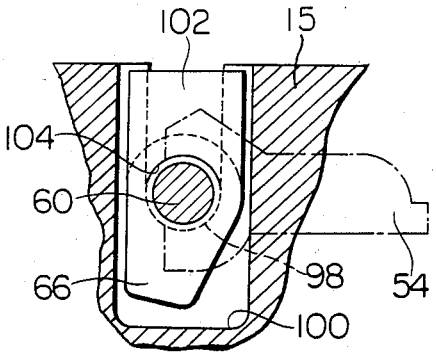

In these FIGS. 8 to 10 in which the groove 100 is illustrated with the arm support 54 placed in position within the U-shaped slots 96 and 98 in a sectional view taken along the line passing through the center line of the partition wall 15, FIG. 8 illustrates the normal contact closed position of the arm support 54 in which the cam-shaped stopper 66 is not in contact with the stopper groove 100 and in a position in which a counterclockwise rotation (as viewed in FIG. 8) of the arm support 54 is allowed, and FIG. 9 illustrates the contact open position of the arm support 54 in which the stopper 66 is in contact with the stopper surface of the groove 100 and further counterclockwise rotation is prevented. FIG. 10 shows that a stopper plate 102 is inserted in the respective grooves 100 until its semicircular recess 104 reaches the pivot stud 60 of the arm support 54 in order prevent the arm support 54 and hence the movable contact structure 18 from moving out of place.

Figure 11:
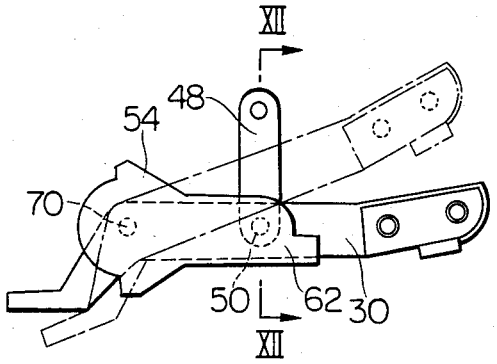
FIG. 11 is a side view of a movable contact structure with a toggle link connected to the arm support.
Figure 12:
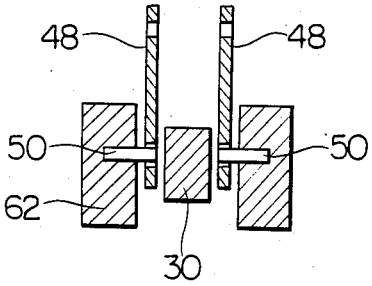
FIG. 12 is a sectional view taken along the line IX—IX of FIG. 11.

In FIGS. 11 and 12, the movable contact structure 18 is illustrated with one of the toggle link pair 48 pivotally connected by pins 50 to the side arms 62 of the arm support 54. As best shown in FIG. 12, each respective side arms 62 has connected thereto one of the toggle links 48, and the toggle links 48 are spaced apart by a distance that is sufficient for accommodating the movable contact arm 30 therebetween in order not to obstruct the opening and closing movements of the movable contact arm 30 between the positions illustrated in dot-and-dash lines and the solid lines in FIG. 11.

Figure 13:
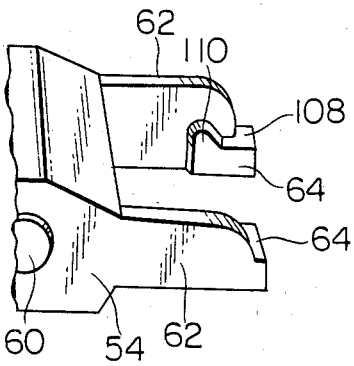
FIG. 13 is a fragmental view illustrating a movable contact structure having projections for limiting lateral swinging movement of the movable contact arm with respect to the arm support.
Figure 14:
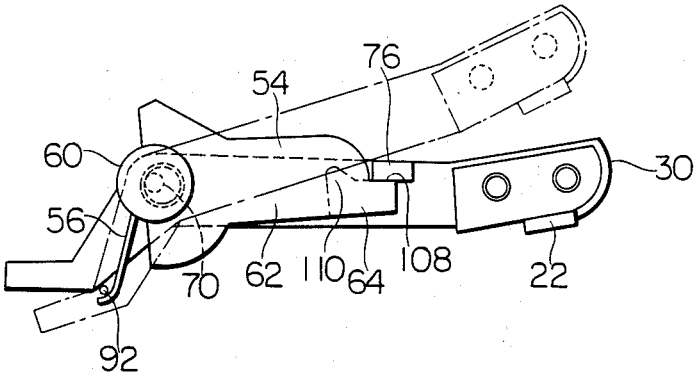
FIG. 14 is a side view of the movable contact structure illustrating the manner in which the projections engage between the contact arm and the arm support.

As seen from FIGS. 13 and 14, each of the projections 64 formed on the tip portions of the side arms 62 has one portion 108 that has a flat top surface for engaging the projection 76 on the movable contact arm 30, and another portion 110 that has a sliding guide surface respectively facing toward each other and spaced apart by a distance suitable for accommodating and guiding the movable contact arm 30.

In the normal condition, by turning the operating lever 51 to the right, the upper toggle link 46 and the lower toggle link 48 are extended as shown in FIG. 1 so that the arm support 54 connected to the toggle mechanism 46, 48 is subjected to a contact closing force in the clockwise direction as shown in the drawing about the central axis of the cross bar 32 to cause the movable contact element 22 to contact with the reaction contact element 20. At this time, since the engaging portions of the operating mechanism 24 are kept engaged, the toggle mechanism 46, 48 is maintained in the illustrated extended position so that the contact elements 20 and 22 are kept contacting to close the electrical circuit in the circuit interrupter.

In the above described closed circuit condition, when it is assumed that an overcurrent flows through the electric path extending through the interrupter, the solenoid 40 or the bimetal 42 of the operating mechanism is actuated to disengage the above mentioned engagement between the engaging portions of the operating mechanism 24. Therefore, the upper toggle link 46 and the lower toggle link 48 collapse to apply a counterclockwise rotating force about the shaft 32 to the arm support 54, so that the movable contact element 22 is separated from the reaction contact element 20. At this time, the reaction contact arm 16 is subjected to an electromagnetic repulsive force and is rotated clockwise about the shaft 32 to separate from the movable contact arm 30. Thus, the electric circuit extending in the circuit interrupter is automatically interrupted.

With the arrangement as described above, the positional restriction of the movable contact elements 22 is achieved without bringing the movable contact arm 30 into direct abutment with the stopper, thereby causing no deformation of the movable contacts due to impact and not limiting the characteristics thereof including its contacting pressure. Also, since the cam-shaped stoppers 66 are integrally formed with the pivot portion 60 of the arm support 54, no additional separate parts are required, realizing a low cost, an easy assembly and a higher dimensional accuracy.

The circuit interrupter as described above is of the multi-pole type, and the poles are communicated with each other at the regions of the bearing portions or the U-shaped grooves 96 and 98. However, the poles can be separated by the stoppers 66 inserted in the grooves 100. That is, the stoppers 66 also have the function of insulating members. In this connection, in order to provide more complete insulation, an insulating plate 102 may be inserted from the upper openings of the grooves 100 as shown in FIG. 10.

As shown in FIGS. 11 and 12, the pair of side arms 62 of the arm support 54 has planted on its inner walls metallic pins 50 by the insert forming method. The projecting end of the pins 51 in each pole face towards each other and are spaced apart from each other by a distance sufficient to allow the movable contact arm 30 to move therethrough. The pins 106 pivotally support the lower portion of the lower link 48.

With this arrangement, since there is no obstacle above the movable contact arm 30, the upward rotation of the movable contact arm 30 relative to the arm support 54 due to an electromagnetic repulsive force generated between the contact arms is not limited during separation, and therefore the separation distance can be made larger, ensuring easier interruption.

Further, since the movable contact arm 30 does not abut against the pins 50 upon separation, the pins 50 need not be secured on the side members 62, and it is only required that the fixed ends of the pins 106 be partially embedded in the outer walls of the side members 62 as illustrated in FIG. 12. With this arrangement, since the pins 50 do not project outwardly of the side arms 62, the insulating distance between the movable contacts of the neighboring poles of a multi-pole type circuit interrupter can be made larger.

FIG. 13 illustrates the structure of the moving parts of the embodiment of the present invention. As shown in the figure, the inner walls of the pair of side arms 62 of the arm support 54 at its end portion have integrally formed thereon a projection portion 64 composed of a flat portion 108 and a land portion 110. This projection portion 64 is to effect the lateral positional restriction of the movable contact arm 30 and hence the movable contact element 22. That is, even when the movable contact arm 30 tends to laterally swing during its rotation, the side surface of the movable contact arm 30 engages against the land portion 110, thereby preventing the lateral swinging movement of the movable contact arm 30. In this case, since the projection portion 64 is disposed at the tip portion of the side arms 62, the effect of the position limiting is greater than where the projection is disposed at the root portion close to the journal portion 96 and 98. It is to be noted that the movable contact arm 30 has formed on its both sides a projection 76 (see FIG. 2), which is adapted to engage with the flat portion 108 of the projection portion 64 of the side arms 62.

Also, with the above arrangement, the center of rotation of the movable contact arm 30 and the center of the rotation of the arm support 54 are on the pivot pin 60 and they are in registry. Therefore, the length of the arm of the movable contact arm 30 can be longer than that of the prior art contact arm. This results in a smaller angle of rotation of the movable contact arm 30 for obtaining the neccessary separation distance as compared with the prior art angle of rotation. Therefore, the electromagnetic repulsive operation of the movable contact arm 30 is quicker than the prior art, and the contacting pressure spring 56 is subjected to less fatigue and has a longer operational life.

Accordingly, while the fatigue of the contacting pressure spring 56 can be the same as that in the conventional design, the separation distance is increased for a same angle of rotation, thereby to improve the interrupting performance.

As had been described above, many advantageous effects are obtained according to the present invention. For example, since the journal portion and the stopper are integrally formed on the arm 54, and since the journal portion is journaled by the bearing portion in the base and the stopper housed within the groove of the base so that the stopper abuts against the inner wall of the groove upon the separation of the movable contact. Therefore, the movable contact is prevented from being deformed by the shock due to its direct contact with the stopper, thereby eliminating the characteristic change thereof. Also, the numbers of parts and the assembly steps can be decreased and the dimensional accuracy can be improved.

Further, since the pin for connecting the toggle link and the arm support is planted on the respective inner walls of the side walls of the arm support and the projecting ends of the pins are spaced apart by the distance necessary for the movement of the movable contact arm therebetween, the separation distance of the movable contact arm can be made large, thereby making it possible to improve the interrupting capacity.

Still further, since the projection portion for laterally positioning the movable contact arm is disposed on the inner wall of the tip portion of the pair of side members formed on the arm, the lateral swing of the movable contact can be limited by a very simple structure. Therefore, the movable contact can be ensured to contact with the reaction contact, providing a reliable circuit interrupter capable of providing a stable contacting.

Still further, since the leg portions of the contacting pressure spring can be independently engaged, the assembly of the contacting pressure spring is simple, enabling easy assembly thereof.

Still further, since the centers of rotation of the movable contact arm and the arm support for supporting the movable contact arm are in alignment, the electromagnetic repulsive movement of the movable contact arm is rapid and the fatigue of the contacting pressure spring is lessened resulting in a longer operating life.

What is claimed is:

1. A circuit interrupter comprising in an electrically insulating housing:

a pair of separable contact structures each including a contact element, at least one of said contact structures being movable between a closed position and an open position relative to the other contact structure for opening and closing an electric circuit extending through the circuit interrupter;

said movable contact structure having an arm support that is pivotal about an axis, a movable contact arm pivotally supported on said arm support, and a biasing means connected between said arm support and said movable contact arm for biasing said movable contact arm to a predetermined position with respect to said arm support; and an operating mechanism connected to said arm support of said movable contact structure for separating said movable contact structure from said other contact structure;

said housing having formed therein a stopper surface, and said movable contact arm having a stopper projecting from said movable contact arm and engageable with said stopper surface on said housing for limiting the range of movement of said movable contact arm.

2. A circuit interrupter as claimed in claim 1 wherein said biasing means comprises a substantially U-shaped double torsion spring having two leg portions of the "U" independently engaging said arm support and a bight portion of the "U" engaging said movable contact arm, thereby enabling said two leg portions of the "U" to be brought into the engagement with said arm support independently of each other.

3. A circuit interrupter as claimed in claim 2, wherein said arm support has a spring engaging pin extending therethrough, and said leg portions engage said pin.

4. A circuit interrupter as claimed in claim 3, wherein said spring engaging pin has formed at its opposite ends circumferential grooves for receiving therein said leg portions of the U-shaped torsion spring.

5. A circuit interrupter as claimed in claim 1, wherein said stopper projects from a pivoted end of said movable contact arm and is engageable with said stopper surface on said housing.

6. A circuit interrupter as claimed in claim 5, further comprising means, disposed between said arm support and said movable contact arm, for limiting a range of lateral swinging movement of said movable contact arm about an axis perpendicular to said pivot axis of said movable contact arm.

7. A circuit interrupter comprising in an electrically insulating housing:

a pair of separable contact structures each including a contact elements, at least one of said contact structures being movable between a closed position and an open position relative to the other contact structure for opening and closing an electric circuit extending through the circuit interrupter said movable contact structure having an arm support that is pivotal about an axis, a movable contact arm pivotally supported on said arm support and extending in a parallel and in an opposite direction to said other contact structure for generating an electromagnetic repulsive force therebetween, and a biasing means connected between said arm support and said movable contact arm for biasing said movable contact arm to a predetermined position with respect to said arm support; and an operating mechanism connected to said arm support of said movable contact structure for separating said movable contact structure from said other contact structure in response to an overcurrent flowing through the circuit interrupter;

said housing having formed therein a stopper surface;

said arm support having a stopper projecting therefrom engageable with said stopper surface on said housing for limiting the range of the movement of said movable contact arm.

8. A circuit interrupter as claimed in claim 6, wherein said stopper is an integral mold extending from said arm support.

9. A circuit interrupter as claimed in claim 1, wherein said operating mechanism includes a toggle link assembly having two pairs of toggle links horizontally spaced apart by a distance sufficient for accommoding the movement of said movable contact arm therein, both of said toggle links connected at one end to said arm support.

10. A circuit interrupter as claimed in claim 1, wherein said movable contact arm has a common pivot axis with said pivot axis of said arm support.

11. A circuit interrupter as claimed in claim 1, wherein said movable contact arm extends in parallel and opposite direction to said other contact structure for generating an electromagnetic repulsive force therebetween.

* * * * *